US006019463A

United States Patent [19]

Waseda

[11] Patent Number: 6,019,463

[45] Date of Patent: Feb. 1, 2000

[54] INK CARTRIDGE

[75] Inventor: Takayuki Waseda, Fuchu, Japan

[73] Assignee: Citizen Watch Co., Ltd, Tokyo, Japan

[21] Appl. No.: 08/963,124

[22] Filed: Oct. 28, 1997

Related U.S. Application Data

[63] Continuation of application No. 08/444,047, May 18, 1995, abandoned.

[30] Foreign Application Priority Data

May 20, 1994 [JP] Japan ..... 6-106900

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS

| | | | |
|---|---|---|---|
| 4,436,439 | 3/1984 | Koto | 347/87 |
| 4,771,295 | 9/1988 | Baker et al. | 347/87 |
| 5,156,472 | 10/1992 | Suzuki et al. | 347/86 |
| 5,182,581 | 1/1993 | Kashimura et al. | 347/87 |

FOREIGN PATENT DOCUMENTS

| | | | |
|---|---|---|---|
| 59850 | 4/1983 | Japan | 347/86 |
| 63-176635 | 11/1988 | Japan . | |
| 101971 | 4/1991 | Japan | 347/87 |
| 104735 | 4/1993 | Japan | 347/86 |
| 31930 | 2/1994 | Japan | 347/86 |

*Primary Examiner*—N. Le
*Assistant Examiner*—Judy Nguyen
*Attorney, Agent, or Firm*—Finnegan, Henderson, Farabow, Garrett & Dunner, L.L.P.

[57] ABSTRACT

A removable ink cartridge having a generally rectangular parallelepiped ink container having a top wall with a vent hole, a bottom wall with a recess and an ink supply hole, and side walls with vertical ribs. A larger felt block having a low density is arranged in the chamber and a small felt block having a high density is arranged in the recess. An elastic tubular plug is fitted in the ink supply hole to receive a tubular member of a printing head. The tubular plug has a thin membrane having a central hole the diameter of which is small when the tubular member is not inserted in the tubular plug and is enlarged when the tubular member is inserted in the tubular plug sufficiently to push and to deform the thin membrane.

15 Claims, 8 Drawing Sheets

INK CARTRIDGE

This application is a continuation of application Ser. No. 08/444,047, filed May 18, 1995, now abandoned.

BACKGROUND OF THE INVENTION

1. Field of the Invention

The present invention relates to an ink cartridge for storing and supplying ink to a printer and, in particular, to an ink jet printer.

2. Description of the Related Art

An ink cartridge supplies ink to a printing head which ejects droplets of ink. The ink cartridge includes an ink holding member arranged in an ink container made from a porous material such as urethane foam, to prevent occurrences of air bubbles and ink leakage which might occur when the ink is moved in the ink cartridge.

A proposal has been made in the prior art that ink is held in the ink holding member by capillary attraction so that an appropriate negative pressure level is maintained in the ink container (for example, U.S. Pat. No. 4,771,295).

For example, FIG. 10 in the attached drawings shows a conventional ink cartridge designed to move ink towards an ink supply hole in the ink cartridge. In FIG. 10, the ink cartridge comprises a generally rectangular parallelepiped ink container 50 having a top wall 51 with a vent hole 52, a bottom wall 53 with an ink supply hole 54, and side walls 55 between the top wall 51 and the bottom wall 52. The top wall 51 includes ribs 56 on the inner surface thereof. An ink holding member of a porous material 57 is arranged in the ink container 50 in abutment with the bottom wall 53, the side walls 55 and the ribs 56 under pressure.

A tubular projection 58 extends in the ink container 50 to form the ink supply hole 54 and to locally compresses a portion of the ink holding member 57. A filter 59 is arranged on the top of the tubular projection 58, and a member 60 which is a part of a printing head of a printer is connected to the ink supply hole 54 to eject droplets of ink. In this arrangement, a portion of the ink holding member 57 located near the ink supply hole 54 has a higher fiber density than that of the remaining portion, so a capillary attraction force is greater at that portion of the ink holding member 57 near the ink supply hole 54 than a capillary attraction force at the remaining portion, whereby ink is gathered near the ink supply hole 54. However, this ink gathering action is not effective in the entire ink holding member 57, and ink located at a position remote from ink supply hole 54 can remain unconsumed. In addition, the provision of the tubular projection 58 extending in the ink container 50 reduces the available volume of the ink container 50, leading to a lower volumetric efficiency.

In addition, if the ink cartridge is integrally connected to the printing head, it is necessary to replace the ink cartridge together with the printing head when the ink in the ink cartridge is consumed. The printing head is more expensive than the ink cartridge, and the cost of the print cartridge increases.

An ink cartridge adapted to be removably connected to a printing head is disclosed in, for example, Japanese Unexamined Utility Model Publication (Kokai) No. 63-176635. FIG. 11 in the attached drawings shows a conventional ink supply device including an ink cartridge 50*a* removably connectable to a printing head 60*a*. The ink cartridge 50*a* has a plug member 61 of an elastic material arranged in an ink supply hole 54*a*. The printing head 60*a* has a hollow needle 62 at a position corresponding to the plug member 61.

When the ink cartridge 50*a* is connected to the printing head 60*a*, the hollow needle 62 passes through the plug member 61 to allow ink to flow from the ink holding member 57*a* through the hollow needle 62 to an ink reservoir 63 in the printing head 60*a*. It is then possible to remove the cartridge 50*a* from the printing head 60*a* by drawing the hollow needle 62 from the plug member 61. Therefore, it is possible to replace only the ink cartridge 50*a* when the ink is consumed and to reduce the cost of the print cartridge. However, it is necessary to provide guide means or positioning means when the ink cartridge 50*a* is connected to the printing head 60*a*, resulting in a complex structure. In addition, if the hollow needle 62 is contaminated with dust at its tip or peripheral surface, dust may enter the ink cartridge 50*a* and may clog the ink passage in the hollow needle 62 or the ink passage in the printing head 60*a*.

SUMMARY OF THE INVENTION

The object of the present invention is to solve the above described problems and to provide an ink cartridge which has a higher volumetric efficiency to increase the available volume to contain ink therein and to reduce the amount of residual ink when the ink cartridge is replaced.

Another object of the present invention is to provide a printer comprising an ink cartridge removably connected to a printing head in which the ink cartridge can be easily connected to the printing head, without allowing entry of dust and leakage of ink, when the ink cartridge is replaced.

According to the present invention, there is provided an ink cartridge adapted to be removably connected to a printing head of a printer, the ink cartridge comprising a generally rectangular parallelepiped ink container having a top wall with a vent hole, a bottom wall with an ink supply hole, and four side walls between the top wall and the bottom wall. The bottom wall has a recess in the interior surface thereof, the ink supply hole being in communication with the recess. Connecting means is provided for removably connecting the ink supply hole to a printing head. The side walls have inner surfaces and ribs are arranged on at least a part of the inner surfaces of the side walls. Ink holding means made of a fibrous material is arranged in the ink container in abutment with the bottom wall, the top wall and the ribs under pressure.

According to a further aspect of the present invention, there is provided an ink supply device comprising a printing head and an ink cartridge removably connected to the printing head. The ink cartridge has an ink supply hole and an elastic tubular plug retained in the ink supply hole, the tubular plug having a through hole and a thin membrane across the through hole. The thin membrane has a small central hole having a diameter. The printing head has a tubular member adapted to be received by the tubular plug, the tubular member having a hole having a diameter. The tubular plug and the tubular member are designed such that the diameter of the central hole of the tubular plug is smaller than the diameter of the hole of the tubular member when the tubular member is not inserted in the tubular plug and the diameter of the central hole is enlarged to ensure a flow area when the tubular member is inserted in the tubular plug sufficiently to push and to deform the thin membrane.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
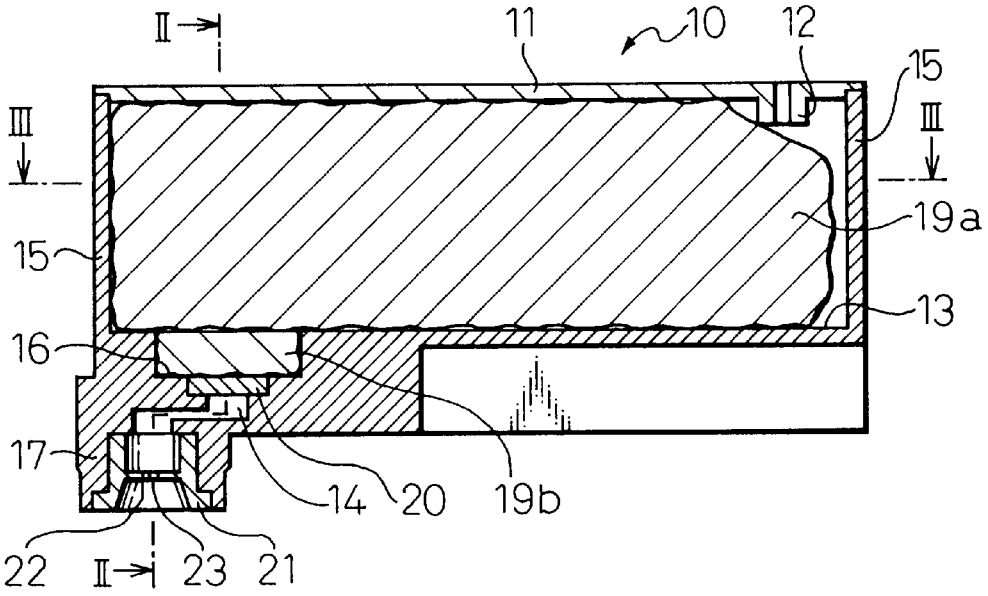
FIG. 1 is a longitudinal cross-sectional view of an ink cartridge according to the first embodiment of the present invention.
Figure 2:
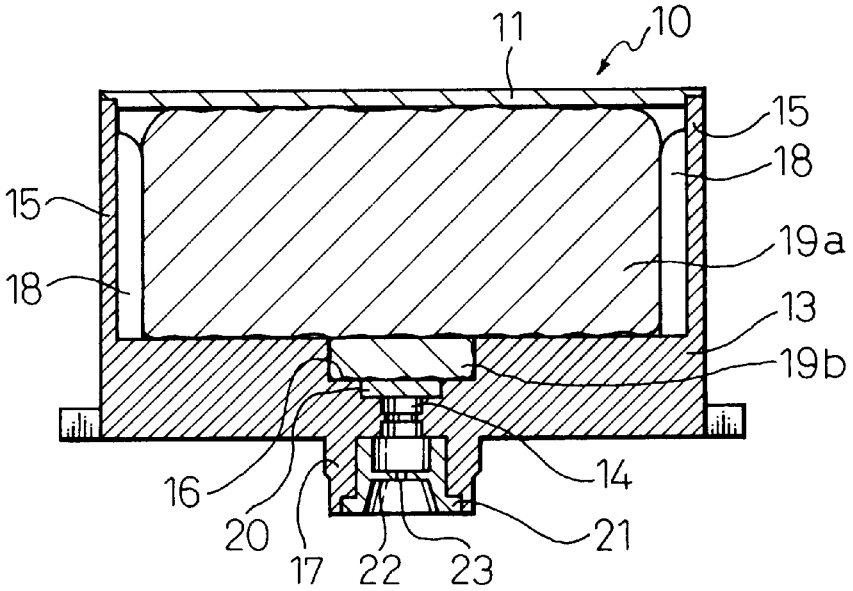
FIG. 2 is a transverse cross-sectional view of the ink cartridge of FIG. 1, taken along the line II—II of FIG. 1.
Figure 3:
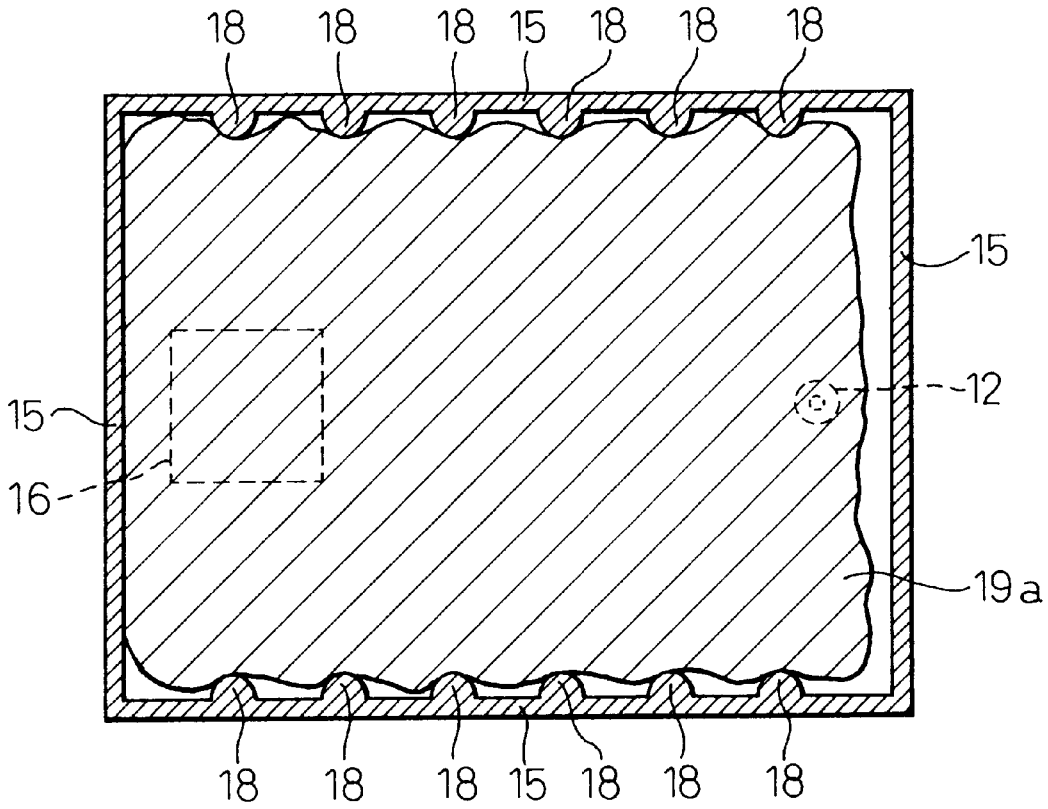
FIG. 3 is a horizontal cross-sectional view of the ink cartridge of FIG. 1, taken along the line III—III of FIG. 1.
Figure 4:
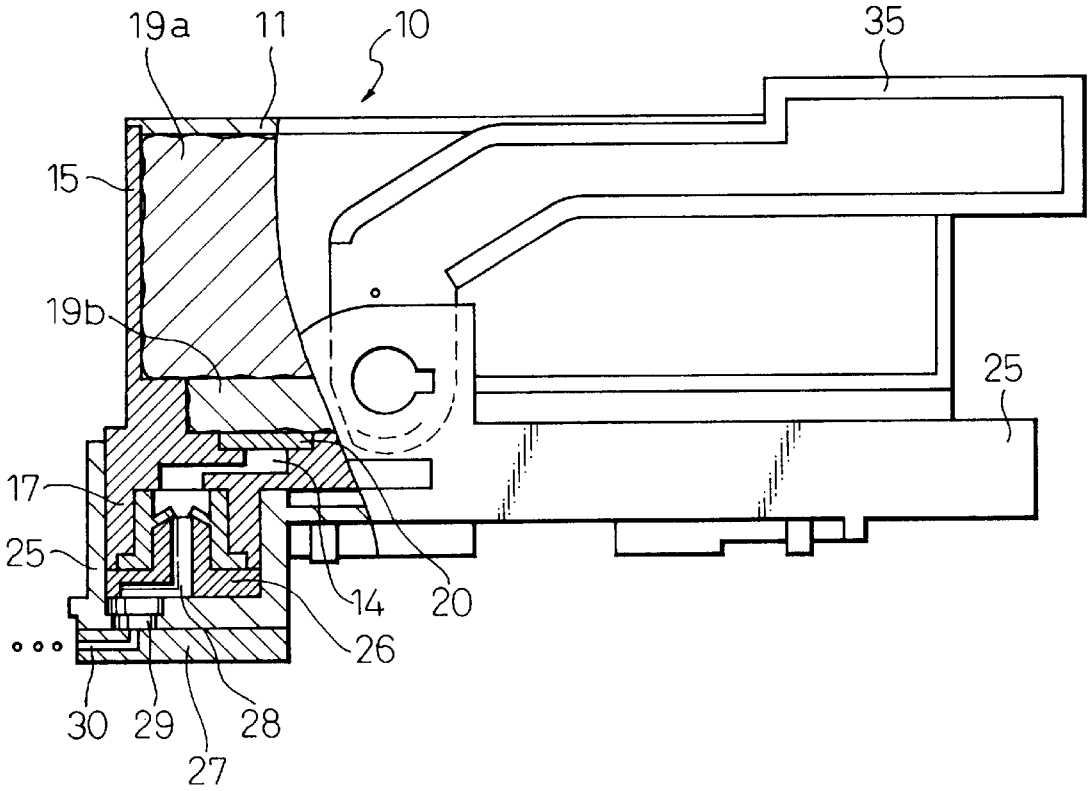
FIG. 4 is a view of an ink cartridge and a printing head.

Referring to FIG. 1 to 3, the ink cartridge 10 comprises a generally rectangular parallelepiped ink container having a top wall 11 with a vent hole 12 in the form of an inwardly projecting post, a bottom wall 13 with an ink supply hole 14, and four side walls 15 between the top wall 11 and the bottom wall 13.

The bottom wall 13 has a recess 16 in the interior surface thereof, and a connecting portion 17 for removably connecting the ink supply hole 14 to a printing head. The ink supply hole 14 is in communication with the recess 16, that is, the ink supply hole 14 has an opening at the bottom surface of the recess 16.

The vent hole 12 is arranged in the top wall 11 near one end of the container on a longitudinal center line thereof and the recess 16 in the bottom wall 13 on the longitudinal center line near an opposite end of the container.

Ribs 18 are arranged substantially at a constant pitch on the inner surfaces of the side walls 15 which are parallel to the longitudinal axis of the ink cartridge, as shown in FIG. 3. The ribs 18 extend vertically from the upper surface of the bottom wall 13, but do not reach the top wall 11 and there is a gap between the top of the ribs 18 and the lower surface of the top wall 11, as shown in FIG. 2.

An ink holding means, made of a fibrous material, is arranged in the ink container. The ink holding means comprises a plurality of ink holding members or felt blocks having different fiber densities. In the embodiment, a main, larger ink holding member 19*a* is arranged in the chamber defined by the top wall 11, the bottom wall 13, and the side walls 15, and a supplemental, smaller ink holding member 19*b* is closely arranged in the recess 16. The upper surface of the supplemental ink holding member 19*b* is generally flush with the upper surface of the bottom wall 13, so that the main ink holding member 19*a* closely contacts the supplemental ink holding member 19*b* but the supplemental ink holding member 19*b* does not give the main ink holding member 19*a* a local compression force.

The main ink holding member 19*a*, in the initial form, has a height greater than that of the chamber and is compressed by the top wall 11 when the top wall 11 is attached to the side walls 15 of the ink cartridge 10. For example, the main ink holding member 19*a* is compressed by the top wall 11 by approximately 25 percent. The main ink holding member 19*a* is also laterally compressed by the ribs 18 by approximately 15 percent. The main ink holding member 19*a* is thus arranged in the ink container in abutment with the bottom wall 13, the top wall 11 and the ribs 18 under pressure. The main ink holding member 19*a* does not contact the vent hole 12 and one side wall 15 which is located near the vent hole 12.

The main ink holding member 19*a* and the supplemental ink holding member 19*b* are made from felt blocks using a fiber of the polyester group, for example. The felt blocks are treated with a surface-active agent to improve its water absorptive property. The ratio of the volume of the supplemental ink holding member 19*b* relative to that of the main ink holding member 19*a* is approximately 1/60. The supplemental ink holding member 19*b* has a higher fiber density than that of the main ink holding member 19*a*. The fiber density can be controlled by changing manufacturing conditions of the felt blocks. The higher the fiber density is, the greater the capillary attractive force is. Therefore, a the strong capillary attractive force exits in the supplemental ink holding member 19*b* which is located near the ink supply hole 14 and a relatively weak capillary attractive force exits in the main ink holding member 19*a* which is located far from the ink supply hole 14, whereby ink is gathered near the ink supply hole 14.

The flow of ink is further improved by the provision of the vertically extending ribs 18 arranged on the side walls 15. As ink moves toward the ink supply hole 14, air gradually enters the main ink holding member 19*a* in place of ink. Air first prevails in a space in the ink cartridge 10 between the main ink holding member 19*a* and the side wall 15 below the vent hole 12, and permeates through the main ink holding member 19*a* from the exposed side surface thereof. Air also flows longitudinally beyond the tops of the ribs 18 into spaces between two adjacent ribs 18, and permeates the main ink holding member 19*a* from the exposed side surfaces thereof. Air thus follows the ink from three sides, so that ink does not remain in the ink cartridge 10 at places remote from the ink supply hole 14.

The main ink holding member 19*a* is a felt block which is compressed to a smaller degree in the manufacturing process to attain a lower fiber density and thus can include a greater amount of ink. A negative pressure prevails in the ink holding members 19*a* and 19*b* but this negative pressure is lower than the ink outputting pressure so that almost all the ink can be consumed.

The supplemental ink holding member 19*b* located near the ink supply hole 14 has a higher fiber density, so that air from the supplemental ink holding member 19*b* does not enter the ink supply hole 14, even if the ink cartridge becomes empty. A filter 20 of a metal mesh is arranged at the top of the ink supply hole 14 to prevent dust from entering the printing head. An elastic tubular plug 21 is arranged in the bottom portion of the ink supply hole 14 at the connecting portion 17 for connecting the ink cartridge 10 to a printing head. The tubular plug 21 has a thin membrane 22 which has a small central hole 23.

The top wall 11 is thermally adhered to the side walls 15 to obtain a sealed structure so that ink does not leak to the outside. The thin vent hole 12 in the form of an inwardly projecting post prevents air from easily flowing out of the chamber to protect the ink in the chamber from drying and to prevent entry of dust. The thin vent hole 12 connects the interior and the exterior of the ink cartridge 10, and accordingly, ink does not leak to the outside when the pressure in the chamber rises due to an environmental temperature change.

Figure 9:
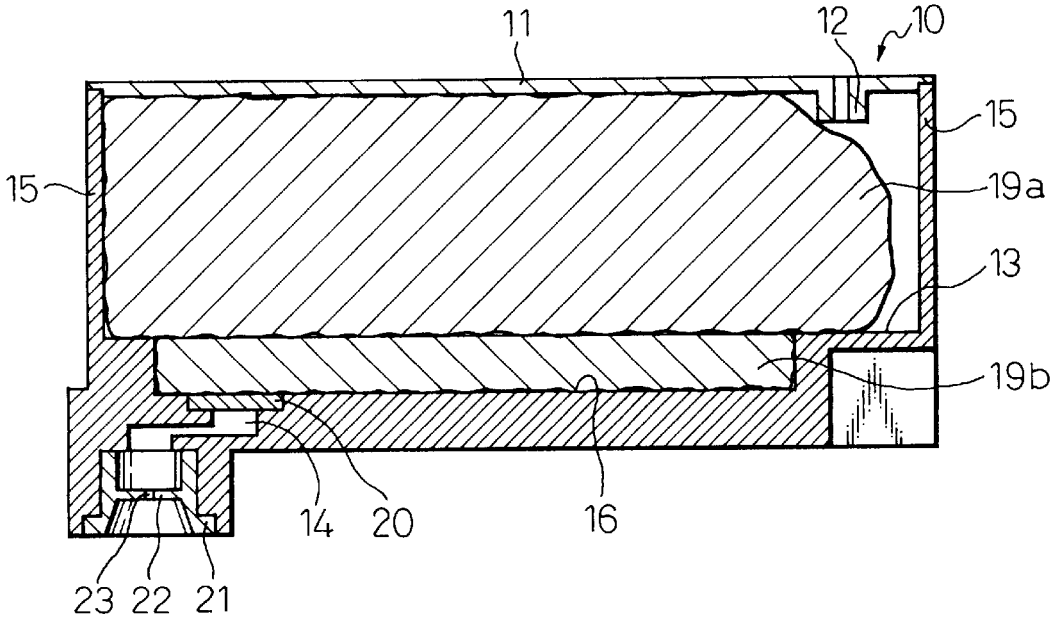
FIG. 9 is a cross-sectional view of an ink cartridge according to the second embodiment of the present invention.
Figure 10:
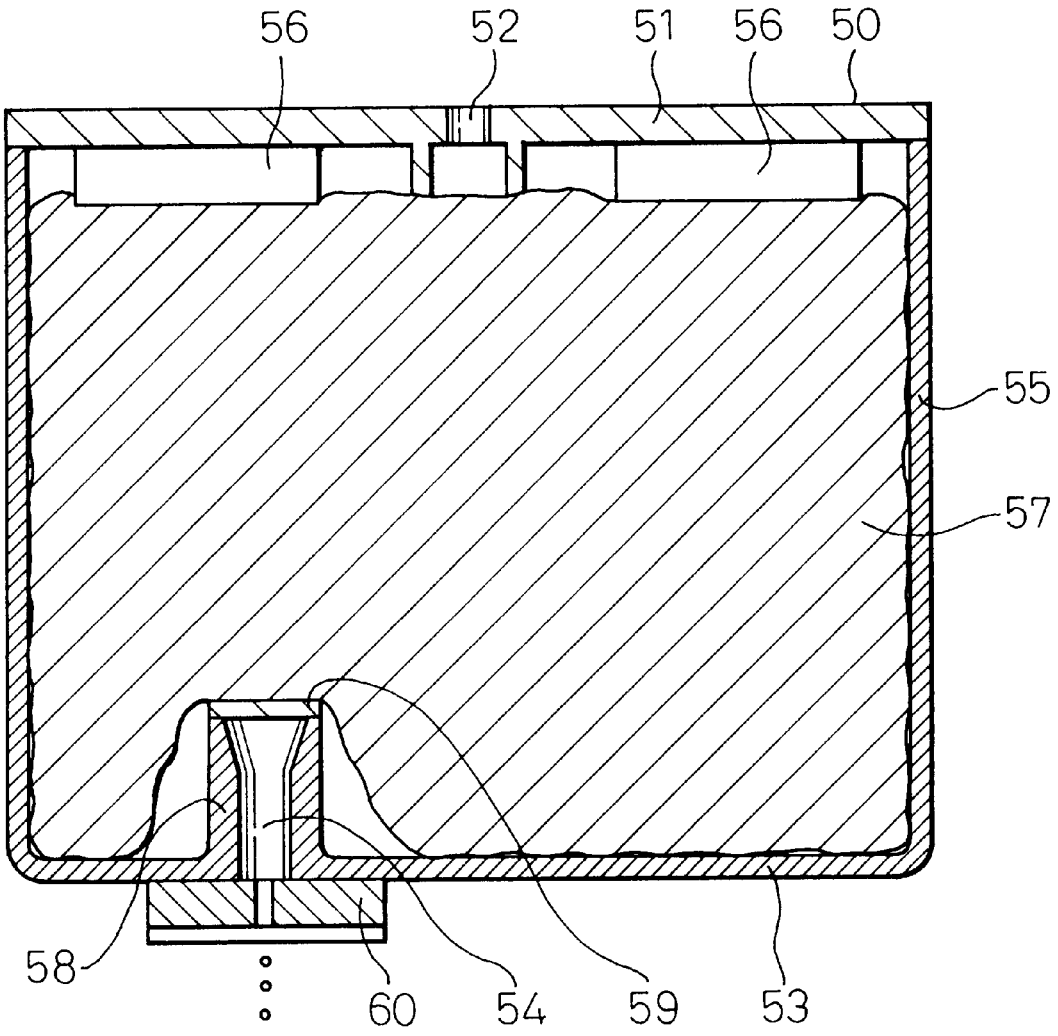
Fig.10 PRIOR ART
FIG. 10 is a cross-sectional view of an ink cartridge of a prior art.
Figure 11:
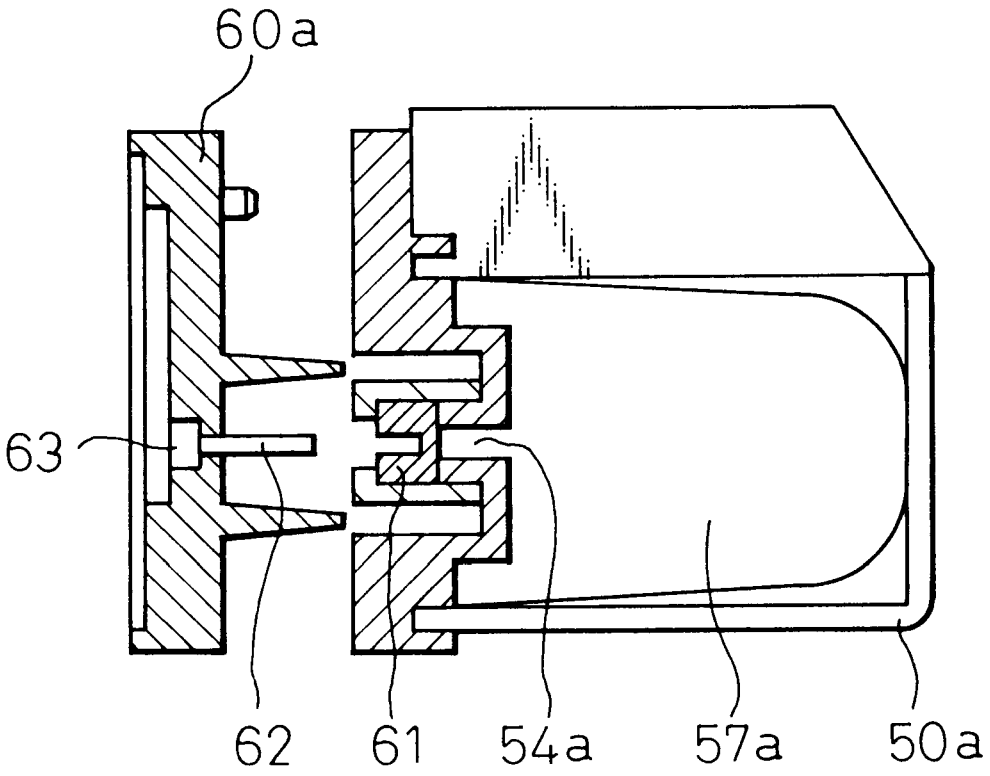
Fig. 11 PRIOR ART
FIG. 11 is a cross-sectional view of a prior art.

FIG. 9 shows the second embodiment of the ink cartridge 10 according to the present invention. In this embodiment, the recess 16 and the supplemental ink holding member 19*b* arranged in the recess 16 are extended toward the side at which the vent hole 12 is arranged so that ink can be gathered from a position far from the ink supply hole 14. The other arrangement is similar to the previous embodiment.

Figure 5:
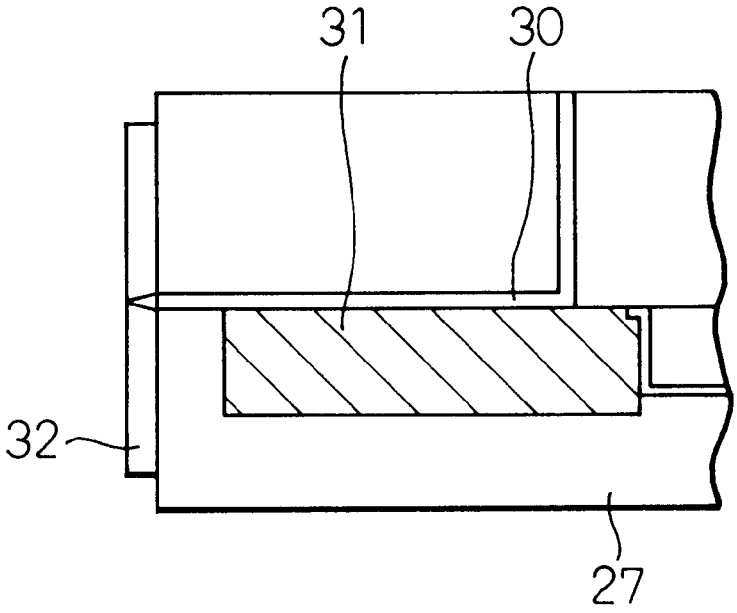
FIG. 5 is an enlarged view of a portion of the printing head of FIG. 4.
Figure 6:
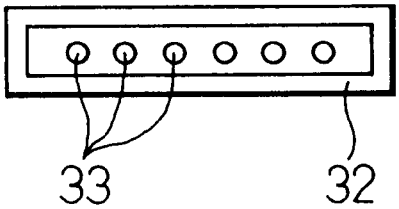
FIG. 6 is a front view of an orifice plate of FIG. 5.

FIGS. 4 to 8 show parts of a printer. The parts include a holder 25 which carries a tubular member 26 at one side thereof and a printing head 27 at the other side. The ink cartridge 10 substantially correspond to the ink cartridge 10 of FIG. 1 or the ink cartridge 10 of FIG. 9. The tubular member 26 is connected to the ink supply hole 14 of the ink cartridge 10. The tubular member 26 has a passage 28, the holder 25 has a passage 29, and the printing head 27 has a passage 30, the ink supply hole 14 of the ink cartridge 10 being in communication with the passages 28, 29 and 30. The printing head 27 has ink discharge means, such as piezoelectric actuators 31, and an orifice plate 32 for ejecting droplets of ink from the printing head 27, as shown in FIG. 5. The orifice plate 32 has a plurality of orifices 33.

Figure 7:
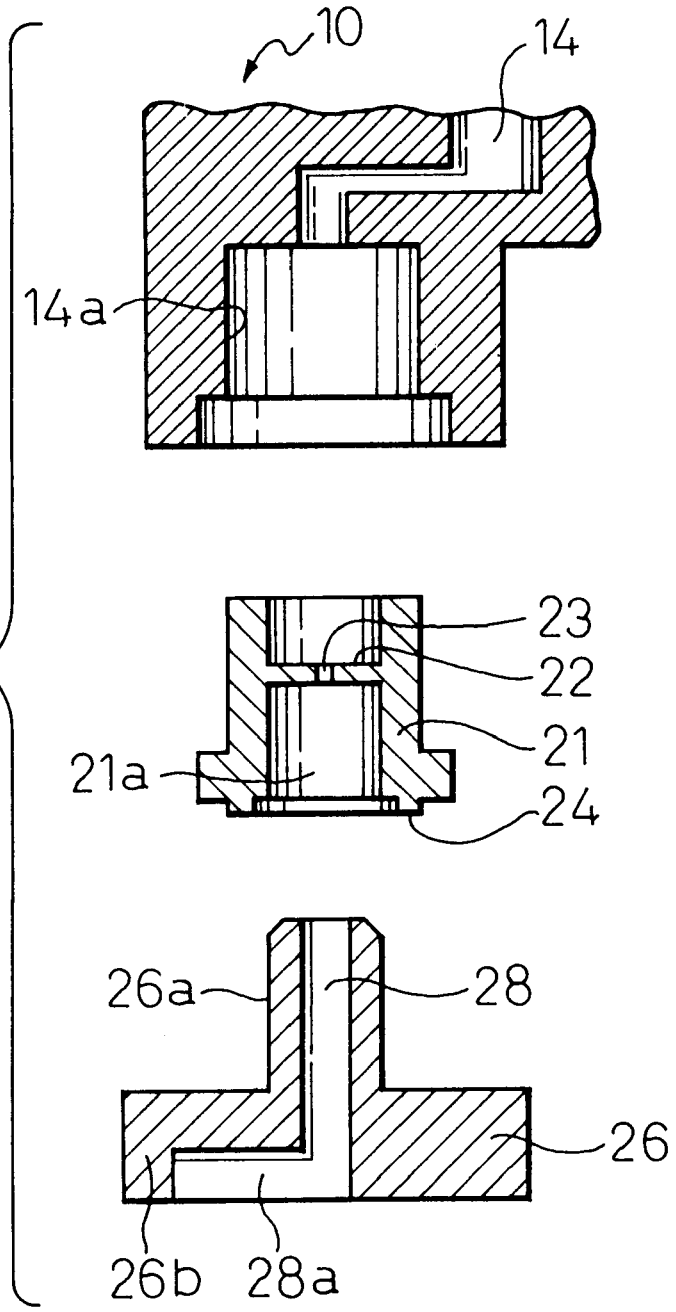
FIG. 7 is an enlarged cross-sectional view of a portion of FIG. 4, with the ink cartridge unconnected to the printing head.
Figure 8:
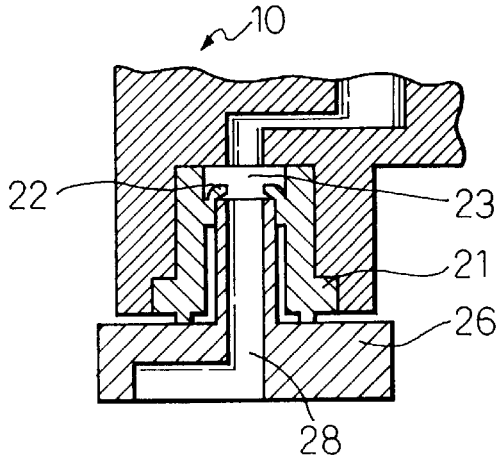
FIG. 8 is a cross-sectional view of the parts in FIG. 7 in the assembled condition.

As shown in FIGS. 7 and 8, the tubular plug 21 having a through hole 21*a* can be first fitted in the bottom portion 14*a* of the ink supply hole 14, and the tubular member 26 can then be received in the tubular plug 21. The tubular plug 21 is made from rubber and the thin membrane 22 is integrally formed with the tubular plug 21 across the through hole 21*a*. The diameter of the small central hole 23 of the thin membrane 22 is smaller than the diameter of the hole (passage 28) of the tubular member 26 when the tubular member 26 is not inserted in the tubular plug 21, as shown in FIG. 7. The tubular plug 21 is first fitted in the ink supply hole 14 and the ink cartridge 10 is transported in this condition as shown in FIG. 1. The small central hole 23 prevents an entry of dust into the ink cartridge 10 and a leakage of ink from the ink cartridge 10, and ink in the ink supply passage 14 is drawn into the chamber by a capillary attraction before or after the use of the ink cartridge 10. The diameter of the central hole 23 is enlarged to ensure a flow area when the tubular member 26 is inserted in the tubular plug 21 sufficiently to push and to deform the thin membrane 22, as shown in FIG. 8. Accordingly, ink is smoothly supplied from the ink cartridge 10 to the printing head 27.

The tubular member 26 comprises a tubular portion 26*a* inserted in the tubular plug 21 and a disk-like base portion 26*b* with a passage portion 28*a*. The tubular plug 21 has an annular projection 24 at the bottom surface thereof. When the tubular member 26 is inserted in the tubular plug 21, the tubular member 26 is centrally located in the tubular plug 21 and the annular projection 24 is urged against the top surface of the base portion 26*a* so as to be deformed to make a sealed structure. Accordingly, the tubular member 26 acts as a connecting member as well as a guide when the ink cartridge 10 is connected to the printing head 27. A lever 35 (FIG. 4) is used when the ink cartridge 10 is connected to the printing head 27 or when the ink cartridge 10 is removed from the printing head 27.

As explained in detail, the ink cartridge according to the present invention can provide a higher volumetric efficiency to increase the available volume to contain ink therein and to reduce the amount of residual ink. In addition, the ink cartridge can be easily connected to the printing head without entry of dust and leakage of ink when the ink cartridge is replaced.

I claim:

1. An ink cartridge adapted to be removably connected to a printing head of a printer, said ink cartridge comprising:

a generally rectangular parallelepiped shaped container having a top wall with a vent hole, a bottom wall with an ink supply hole, and four side walls between the top wall and the bottom wall, said walls forming a chamber therebetween;

said bottom wall of said container having an inner surface with a recess in the inner surface, said recess having a bottom wall with an upper end of said ink supply hole opening into said recess bottom wall and being in communication with said recess;

said side walls having inner surfaces with ribs arranged on at least a part of the inner surfaces of at least some of the side walls, said ribs extending into said chamber;

connecting means for removably connecting the ink supply hole of the container to a printing head;

a first ink holding member made of a fibrous material and arranged in the chamber of the container in abutment with at least the container's bottom wall, the top wall and the ribs under pressure;

a second ink holding member made of a fibrous material and arranged in said recess in the bottom wall of the container with a top surface thereof being in contact with the first ink holding member and generally flush with the inner surface of the bottom wall of the container, the second ink holding member having a higher fiber density than that of the first ink holding member; and a filter located in the recess between the second ink holding member and the upper end of the ink supply hole.

2. The ink cartridge of claim 1, wherein the first and second ink holding members each comprise a felt block.

3. The ink cartridge of claim 1, wherein said ribs extend substantially vertically.

4. The ink cartridge of claim 3, wherein the ribs extend vertically upward from the inner surface of the bottom wall of the container and terminate short of the top wall so that there is a gap between a top of the ribs and an inner surface of the top wall.

5. The ink cartridge of claim 3, wherein said ribs extend substantially at a constant pitch along the length of the side walls.

6. The ink cartridge of claim 3, wherein said container has a longitudinal axis, and said ribs are arranged on opposite side walls that are parallel to the longitudinal axis.

7. The ink cartridge of claim 6, wherein said vent hole is located in the top wall near one end of the container with respect to the longitudinal axis, and said recess is located in the bottom wall near an opposite end of the container.

8. The ink cartridge of claim 7, wherein said vent hole is in the form of a post which projects inwardly from the top wall into the chamber of the container.

9. The ink cartridge of claim 1, wherein said connecting means includes an elastic tubular plug arranged in the ink supply hole and adapted to receive by insertion therein a tubular member on a printing head, the tubular plug having a through hole and a thin membrane across the through hole, the thin membrane having a small central hole that has a diameter smaller than a diameter of a through hole of the tubular member when the tubular member is not inserted in the tubular plug and a diameter enlarged sufficiently to ensure a flow of ink through the ink supply hole to the printing head when the tubular member of the printing head is inserted in the tubular plug enough to deform the thin membrane.

10. The ink cartridge of claim 9, in combination with said tubular member, said tubular member acting as a connecting member as well as a guide when the ink supply hole of the container of the ink cartridge is connected to the printing head.

11. An ink cartridge adapted to be removably connected to a printing head of a printer, said ink cartridge comprising:

a generally rectangular parallelepiped shaped container having a longitudinal axis, a top wall with an inner surface, a vent hole in the top wall near one end of the container with respect to the longitudinal axis, a bottom wall with an ink supply hole, and four side walls between the top wall and the bottom wall, said walls forming a chamber therebetween said vent hole being in the form of a port that projects inwardly from the top wall into the chamber of the container;

said bottom wall of said container having an inner surface with a recess in the inner surface, said recess having a bottom wall with an upper end of said ink supply hole opening into said recess bottom wall and being in communication with said recess, said recess being located in the bottom wall of the container near an end of the container opposite from the vent hole with respect to the longitudinal axis;

said side walls having inner surfaces with ribs arranged on the inner surfaces of opposite side walls that arc parallel to the longitudinal axis, said ribs extending into said chamber and vertically upward from the inner surface of the bottom wall of the container to near the top wall so that there is a gap between a top of the ribs and the inner surface of the top wall, connecting means for removably connecting the ink supply hole of the container to a printing head;

a first ink holding member made of a fibrous material and arranged in the chamber of the container in abutment with at least the container's bottom wall, the top wall and the ribs under pressure;

a second ink holding member made of a fibrous material and arranged in said recess in the bottom wall of the container with a top surface thereof being in contact with the first ink holding member and generally flush with the inner surface of the bottom wall of the container, the second ink holding member having a higher fiber density than that of the first ink holding member; and a filter located in the recess between the second ink holding member and the upper end of the ink supply hole.

12. The ink cartridge of claim 11, wherein the first and second ink holding members each comprise a felt block.

13. The ink cartridge of claim 11, herein said ribs extend substantially at a constant pitch along the length of the side walls.

14. The ink cartridge of claim 11, wherein said connecting means includes an elastic tubular plug arranged in the ink supply hole and adapted to receive by insertion therein a tubular member on a printing head, the tubular plug having a through hole and a thin membrane across the through hole, the thin membrane having a small central hole that has a diameter smaller than a diameter of a through hole of the tubular member when the tubular member is not inserted in the tubular plug and a diameter enlarged sufficiently to ensure a flow of ink through the ink supply hole to the printing head when the tubular member of the printing head is inserted in the tubular plug enough to deform the thin membrane.

15. The ink cartridge of claim 14, in combination with said tubular member, said tubular member acting as a connecting member as well as a guide when the ink supply hole of the container of the ink cartridge is connected to the printing head.

* * * * *

UNITED STATES PATENT AND TRADEMARK OFFICE

CERTIFICATE OF CORRECTION

PATENT NO. : 6,019,463
DATED : February 1, 2000
INVENTOR(S) : Takayuki Waseda

It is certified that error appears in the above-indentified patent and that said Letters Patent is hereby corrected as shown below:

Title page, item [54] and col. 1, should read
--REMOVABLE INK CARTRIDGE FOR AN INK JET PRINTER--.

In Claim 11, col. 7, line 14, after "therebetween", insert --,--.

In Claim 11, col. 7, line 26, "arc" should read --are--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*